US010418712B1

(12) United States Patent
Henderson et al.

(10) Patent No.: US 10,418,712 B1
(45) Date of Patent: Sep. 17, 2019

(54) FOLDED OPTICS MESH HOOP COLUMN DEPLOYABLE REFLECTOR SYSTEM

(71) Applicant: Eagle Technology, LLC, Melbourne, FL (US)

(72) Inventors: Philip J. Henderson, Palm Bay, FL (US); Charles W. Kulisan, Malabar, FL (US); Francisco Torres, West Melbourne, FL (US); Robert M. Taylor, Rockledge, FL (US); Gustavo A. Toledo, Rockledge, FL (US); Ryan Whitney, Indialantic, FL (US); Michael R. Winters, Indian Harbour Beach, FL (US); Dana Monnier Rosennier, Melbourne, FL (US)

(73) Assignee: Eagle Technology, LLC, Melbourne, FL (US)

( * ) Notice: Subject to any disclaimer, the term of this patent is extended or adjusted under 35 U.S.C. 154(b) by 0 days.

(21) Appl. No.: 16/180,836

(22) Filed: Nov. 5, 2018

(51) Int. Cl.
*H01Q 13/00* (2006.01)

(52) U.S. Cl.
CPC ..... *H01Q 13/00* (2013.01)

(58) Field of Classification Search
CPC ..... H01Q 21/00
USPC ..... 343/781 P
See application file for complete search history.

(56) References Cited

U.S. PATENT DOCUMENTS 3,508,270 A 4/1970 Cook
3,739,538 A 6/1973 Rubin
3,780,375 A 12/1973 Cummings et al.
4,550,319 A 10/1985 Ganssle et al.
5,859,619 A 1/1999 Wu et al.
5,864,324 A 1/1999 Acker et al.
5,963,182 A 10/1999 Bassily
6,225,965 B1 5/2001 Gilger et al.
6,278,416 B1 8/2001 Harless
6,323,819 B1 11/2001 Ergene
6,911,953 B2 6/2005 Gothard et al.
7,337,097 B2 2/2008 Ih
9,496,621 B2 11/2016 Meschini et al.
9,608,333 B1 * 3/2017 Toledo ..... H01Q 15/161
9,742,069 B1 * 8/2017 Hollenbeck ..... H01Q 13/02
(Continued)

OTHER PUBLICATIONS

Sullivan, Marvin R., LSST (Hoop/Column) Maypole Antenna Development Program, NASA Contractor Report 3558; NASA-CR-3558-PT-1 19820018481; Contract NAS1-15763, Jun. 1982.
(Continued)

*Primary Examiner* — Andrea Lindgren Baltzell
(74) *Attorney, Agent, or Firm* — Fox Rothschild LLP; Robert J. Sacco; Carol E. Thorstad-Forsyth

(57) ABSTRACT

Folded optics reflector system includes a hoop assembly configured to expand between a collapsed configuration and an expanded configuration to define a circumferential hoop. A mesh reflector surface is secured to the hoop assembly such that when the hoop assembly is in the expanded configuration, the reflector surface is expanded to a shape that is configured to concentrate RF energy in a desired pattern. The system also includes a mast assembly comprised of an extendible boom. The hoop assembly is secured by a plurality of cords relative to a top and bottom portion of the boom, whereby upon extension of the boom to a deployed condition, the hoop assembly is supported by the boom. A subreflector is disposed at the top portion of the boom.

19 Claims, 11 Drawing Sheets

(56) References Cited

U.S. PATENT DOCUMENTS

| | | | |
|---|---|---|---|
| 9,882,608 | B2 | 1/2018 | Adriazola et al. |
| 9,929,755 | B2 | 3/2018 | Henry et al. |
| 2017/0110803 | A1 | 4/2017 | Hodges et al. |

OTHER PUBLICATIONS

Babuscia, A., et al., "Inflatable Antenna for CubeSat: Motivation for Development and Initial Trade Study," Acta Astronautica 91, 322-332 10.1016/j.actaastro.2013.06.005.

* cited by examiner

FOLDED OPTICS MESH HOOP COLUMN DEPLOYABLE REFLECTOR SYSTEM

BACKGROUND

Statement of the Technical Field

The technical field of this disclosure concerns compact antenna system structures, and more particularly, compact deployable reflector antenna systems.

Description of the Related Art

Various conventional antenna structures exist that include a reflector for directing energy into a desired pattern. One such conventional antenna structure is a hoop column reflector (HCR) type system, also known as a high compaction ratio (HCR) reflector, which includes a hoop assembly, a collapsible mesh reflector surface and an extendible mast assembly. The hoop assembly includes a plurality of link members extending between a plurality of hinge members and the hoop assembly is moveable between a collapsed configuration wherein the link members extend substantially parallel to one another and an expanded configuration wherein the link members define a circumferential hoop. The reflector surface is secured to the hoop assembly and collapses and extends therewith. The hoop is secured by cords relative to top and bottom portions of a mast that maintains the hoop substantially in a plane. The mast extends to release the hoop, pull the mesh reflector surface into a shape that is intended to concentrate RF energy in a desired pattern, and tension the cords that locate the hoop. An example of an HCR type antenna system is disclosed in U.S. Pat. No. 9,608,333.

Folded optic reflector antennas include both Cassegrain and Gregorian configurations in which a smaller subreflector is suspended in front of a larger primary reflector. RF energy from an RF feed illuminates the subreflector which in turn reflects the RF energy back toward the primary reflector. The primary reflector is then used to reflect the RF energy once again in a forward direction, thereby forming the final antenna beam. Folded optic reflectors offer various advantages when used in connection with certain space-based communication applications.

SUMMARY

This document concerns a folded optics reflector system. According to one aspect the system includes a hoop assembly. The hoop assembly is comprised of a plurality of link members which extend between a plurality of hinge members. The hoop assembly is configured to expand between a collapsed configuration wherein the link members extend substantially parallel to one another and an expanded configuration wherein the link members define a circumferential hoop. A collapsible mesh reflector surface is secured to the hoop assembly such that when the hoop assembly is in the collapsed configuration, the reflector surface is collapsed within the hoop assembly. When the hoop assembly is in the expanded configuration, the reflector surface is expanded to a shape that is configured to concentrate RF energy in a desired pattern. The system also includes a mast assembly comprised of an extendible boom. The hoop assembly is secured by a plurality of cords relative to a top portion of the boom and to a bottom portion of the boom such that upon extension of the boom to a deployed condition, the hoop assembly is supported by the boom. Further, a subreflector is disposed at the top portion of the boom. In some scenarios, the boom is comprised of a low-loss dielectric material.

In some scenarios, an antenna feed is disposed at the top portion of the boom and the subreflector is supported on one or more struts or an RF transparent radome. The struts and/or the radome can be configured to extend from the top portion of the boom or the antenna feed so as to space the subreflector a predetermined distance from the antenna feed.

In other scenarios, an antenna feed can be disposed at or adjacent to the bottom portion of the boom. In such scenarios a feed aperture can be advantageously provided in the reflector surface and coaxially aligned with an axis of the boom. The antenna feed is configured to illuminate a reflector face of the subreflector with radio frequency (RF) energy that is propagated through the feed aperture.

In some solutions, the antenna feed can be comprised of a plurality of radiating elements which are disposed around a periphery of the boom to form an array. In other scenarios, the antenna feed is a coaxial feed which is axially aligned with the mast assembly. If a coaxial feed is utilized, the feed can be comprised of a cylindrical inner waveguide structure which defines a hollow tubular cavity axially aligned with the mast assembly. Further, at least one deployment component can extend through such tubular cavity to facilitate extension of the boom. Further, at least a portion of the mast assembly can be supported on the cylindrical inner waveguide structure.

The folded optics reflector system can include a housing in which at least the hoop assembly, reflector surface and mast assembly are stowed prior to deployment. In some scenarios, prior to deployment, the subreflector is disposed at a top of the housing, and an antenna feed is disposed in the bottom of the housing. In other scenarios, after deployment, an antenna feed is disposed at the top portion of the boom and the subreflector is supported on one or more struts which extend from the top portion of the boom or the antenna feed so as to space the subreflector a predetermined distance from the antenna feed.

According to one aspect an antenna feed is disposed at or adjacent to the bottom portion of the boom after deployment of the antenna. For example, the antenna feed may be comprised of a plurality of radiating elements which are disposed around a periphery of the boom to form an array. In some scenarios, the boom is comprised of a low-loss dielectric material so as to minimize any distortion of the feed radiation pattern. Further, a feed aperture in the reflector surface can be coaxially aligned with an axis of the boom. The antenna feed in such scenarios can be advantageously configured to illuminate a reflector face of the subreflector with radio frequency (RF) energy that is propagated through the feed aperture.

According to another aspect, the antenna feed is a coaxial feed which is disposed in the bottom of the housing and axially aligned with the mast assembly. In some scenarios, the coaxial feed is comprised of a cylindrical inner waveguide structure which defines a hollow tubular cavity axially aligned with the mast assembly. Further, at least one deployment component extends through the tubular cavity to facilitate extension of the boom. In such scenarios, at least a portion of the mast assembly can be supported on the cylindrical inner waveguide structure.

BRIEF DESCRIPTION OF THE DRAWINGS

This disclosure is facilitated by reference to the following drawing figures, in which like numerals represent like items throughout the figures, and in which.

DETAILED DESCRIPTION

Figure 1:
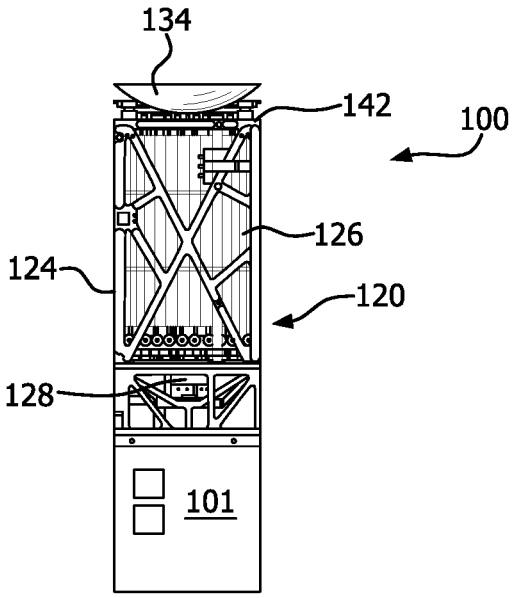
FIG. 1 is a side elevation view of folded optics reflector in a stowed configuration.

It will be readily understood that the solution described herein and illustrated in the appended figures could involve a wide variety of different configurations. Thus, the following more detailed description, as represented in the figures, is not intended to limit the scope of the present disclosure, but is merely representative of certain implementations in various different scenarios. While the various aspects are presented in the drawings, the drawings are not necessarily drawn to scale unless specifically indicated.

Reference throughout this specification to features, advantages, or similar language does not imply that all of the features and advantages that may be realized should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Figure 2:
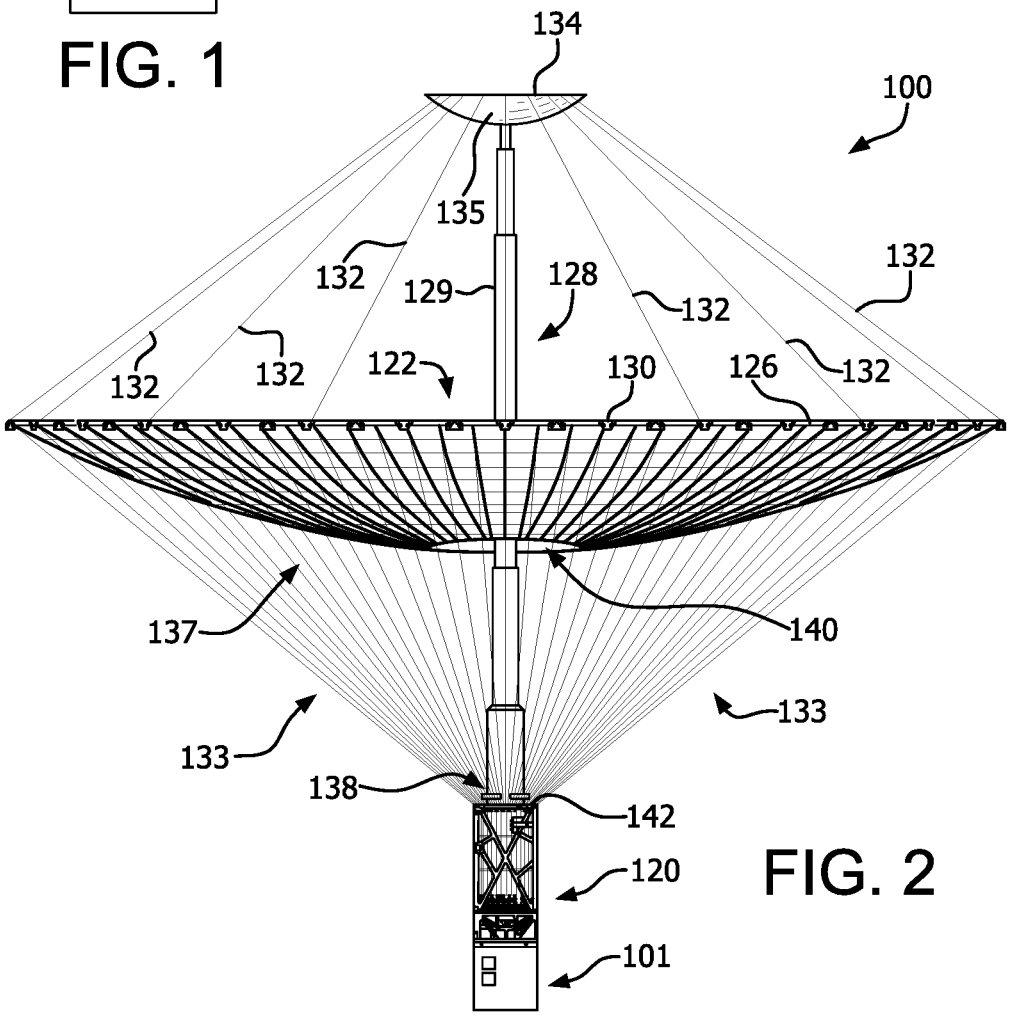
FIG. 2 is a side elevation view of the folded optics reflector of FIG. 1 in a deployed configuration.

Shown in FIGS. 1-2 is a deployable mesh reflector system 100. The deployable mesh reflector system 100 generally comprises a housing or container 120 which is configured to stow a deployable mesh reflector 122. As illustrated in FIGS. 1 and 2, the housing 120 generally comprises a frame structure 124 which defines an interior space for stowing of the deployable mesh reflector 122. In some scenarios, the housing 120 can comprise a portion of a spacecraft 101 which comprises various types of equipment, including radio communication equipment.

The housing frame 124 may have various configurations and sizes depending on the size of the deployable mesh reflector 122. By way of example, the system 100 may include a deployable mesh reflector with a 1 meter aperture that is stowed within a housing 120 that is of 2U cubes at packaging and having an approximately 10 cm×10 cm×20 cm volume. Alternatively, the system 100 may include a deployable mesh reflector with a 3 meter aperture that is stowed within a housing 120 that is of 12U cubes at packaging and having an approximately 20 cm×20 cm×30 cm volume. Of course, the solution is not limited in this regard and other sizes and configurations of the systems are also possible. In some scenarios, the housing 120 is in the nanosat or microsat size range.

The deployable mesh reflector 122 generally comprises a collapsible, mesh reflector surface 130 which is supported by a circumferential hoop assembly 126. The reflector surface has a shape when deployed that is selected so as to concentrate RF energy in a desired pattern. As such, the reflector surface can be parabolic or can be specially shaped in accordance with the needs of a particular design. For example in some scenarios the reflector surface can be specially shaped in accordance with a predetermined polynomial function. Further, the reflector surface 130 can be a surface of revolution, but it should be understood that this is not a requirement. There are some instances when the reflector surface can be an axisymmetric shape.

The hoop assembly 126 is supported by the mast assembly 128 via a plurality of cords 132. Generally, the mast assembly 128 includes an extendable boom 129 with subreflector 134 secured to at a free end thereof. A further network of cords 133 can extend between the housing 120 and the mesh reflector 122 to help define the shape of the mesh reflector surface 130. As illustrated in FIGS. 1 and 2, the hoop assembly 126 and the mast assembly 128 are configured to collapse into a stowed configuration which fits within the interior space of the housing 120. When the antenna system arrives at a deployment location (e.g., an orbital location) the antenna can be transitioned to the deployed configuration shown in FIG. 2.

The subreflector 134 is comprised of a material which is highly reflective of RF energy. The subreflector 134 which is shown in FIGS. 1 and 2 has a convex reflector face 135 to facilitate a Cassegrain type of reflector antenna system, in which the mesh reflector 122 serves as the primary reflector. However, it should be appreciated that implementations are not limited in this regard. In other scenarios the subreflector 134 could also define a concave reflector face to facilitate a Gregorian type of reflector antenna system.

As may be observed in FIG. 2, the subreflector 134, in addition to facilitating a folded optic antenna configuration, can also function as part of the support system for the mesh reflector surface 130. In particular, the structure of the subreflector 134 can be used to anchor or support ends of the cords 132. A drive train assembly (not shown) is positioned within the housing 120 and is configured to telescopically extend, scissor, or unroll to extend the boom 129 from the stowed configuration shown in FIG. 1 to the deployed configuration shown in FIG. 2. The extending of the boom can be facilitated in accordance with various different conventional mechanisms. The exact mechanism selected for this purpose is not critical. As such, suitable arrangements can include mechanisms which involve telescoping sections, mechanisms which operate in accordance with scissoring action and those which unroll from a drum or spool. As explained hereinafter, the hoop assembly 126 is advantageously configured to be self-deploying such that the deployed hoop structure shown in FIG. 2 is achieved without any motors or actuators other than the drive train assembly which is used to extend the mast. Still, the solution is not limited in this respect and in some scenarios a motorized or actuated deployment of the hoop is contemplated.

Deployable mesh reflectors based on the concept of a hoop assembly and an extendable mast are known. For example, details of such an antenna system are disclosed in U.S. Pat. No. 9,608,333 which is incorporated herein by reference. However, a brief description of the hoop assembly is provided with respect to FIGS. 3 and 4 so as to facilitate an understanding of the solution presented herein.

The hoop assembly 126 is comprised of a plurality of upper hinge members 302 which are interconnected with a plurality of lower hinge members 304 via link members 306. Each link member 306 is comprised of a linear rod which extends between opposed hinge members. In the stowed configuration illustrated in FIG. 3, the upper hinge members 302 collapse adjacent to one another and the lower hinge members 304 collapse adjacent to one another with the link members 306 extending therebetween in generally parallel alignment. One or two sync rods 308 may extend between each connected upper and lower hinge member 302, 304. As shown in FIG. 4, the link member 306 and the sync rod 308 are elongated rods extending between opposed ends 312. Each end 312 is configured to be pivotally connected to a respective hinge body 314 of an upper and lower hinge 302, 304 at a pivot point 316. Accordingly, as the hinge members 302, 304 are moved apart as shown in FIG. 4, the link members 306 pivot and the sync rods 308 maintain the rotation angle between adjacent hinge members 302, 304. This arrangement facilitates synchronous deployment of the hoop assembly 126. The hoop may be driven from a stowed state to a deployed state by springs, motors, cord tension, or other mechanism.

Figure 3:
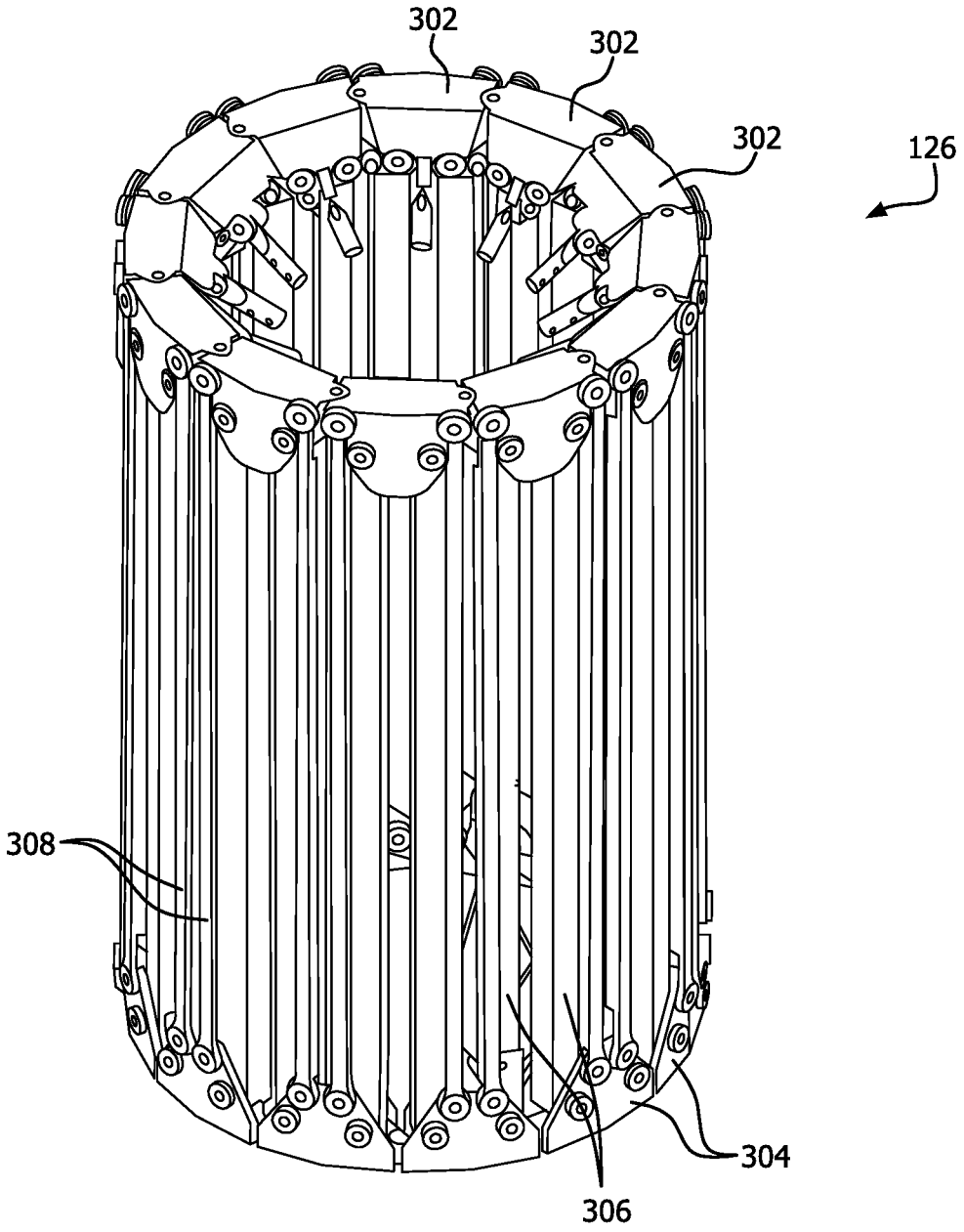
FIG. 3 is an isometric view of an exemplary hoop assembly in a stowed configuration.
Figure 4:
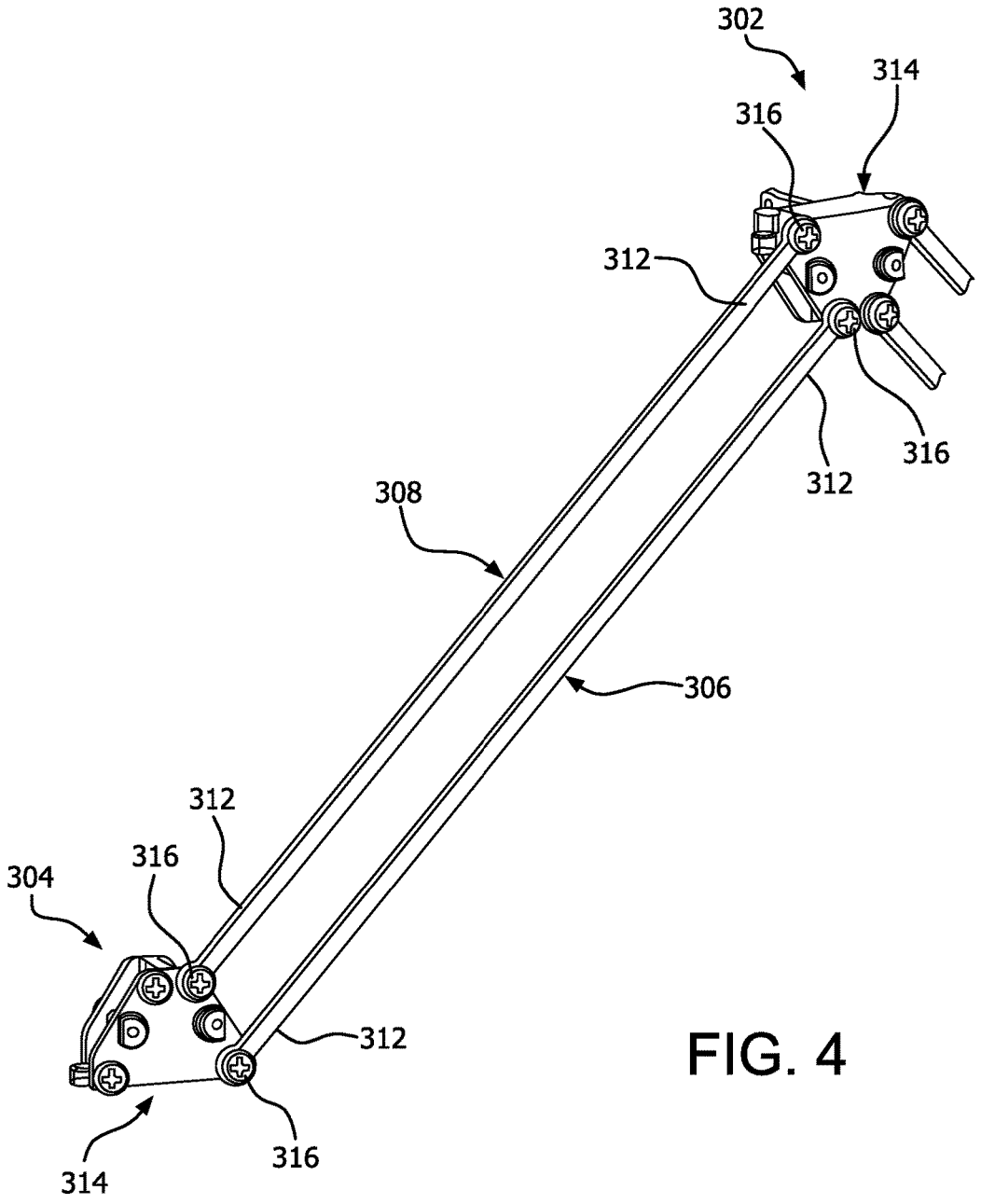
FIG. 4 is an isometric view of a pair of hinge assemblies interconnected by sync rods in a partially deployed configuration.

As shown in FIGS. 3 and 4, the upper and lower hinge members 302, 304 are circumferentially offset from one another such that a pair of adjacent link members 306 which are connected to one upper hinge member 302 are connected to two adjacent, but distinct lower hinge members 304. In this manner, upon deployment, the hoop assembly 126 defines a continuous circumferential hoop structure with link members extending between alternating upper and lower hinge members (see FIG. 1).

The mesh reflector surface 130 is secured to the hoop assembly 126 and collapses and extends therewith. Cords 132, 133 attach each hinge member to both top and bottom portions of the mast 128 so that the load path goes from one end of the mast, to the hinge and to the other end of the mast using the cords. The cords 132, 133 maintain the hoop assembly 126 in a plane. The hoop extends via torsion springs (not shown) which are disposed on the hinges 302, 304. The torsion springs are biased to deploy the reflector to the configuration shown in FIG. 2. Additional cords 137 attach from the collapsible mesh surface 130 to the base of the mast are used to pull the mesh down into a predetermined shape selected for the reflector surface. Accordingly, the hoop is not required to have depth out of plane to form the reflector into a parabola.

The mast 128 can comprise a split-tube type boom which is stored on a spool within a housing 120. As is known, slit-tube booms can have two configurations. In the stowed configuration, the slit-tube boom can flatten laterally and can be rolled longitudinally on a spool within the housing 120. In the deployed configuration, the slit-tube boom can be extended longitudinally and rolled or curved laterally. A drive train assembly within the housing 120 is configured to extend the split tube boom for deployment. While a split type boom is described with respect to the present embodiment, the invention is not limited to such and the mast assembly can have other configurations. For example, in some scenarios the mast assembly can comprise a rolled boom with a lenticular or open triangular cross section, or a pantograph configuration. As a further example, the mast assembly may include a plurality of links joined by hinges which are moveable between a collapsed configuration wherein the link members extend substantially parallel to one another and an expanded configuration wherein the link members align co-linear to one other. As another example, the extendible mast assembly may include a plurality of links that slide relative to one another such that the mast assembly automatically extends from a collapsed configuration where the links are nested together and an expanded configuration wherein the link members extend substantially end to end. The various mast configurations are described in greater detail in U.S. Pat. No. 9,608,333 which is incorporated herein by reference.

Figure 5:
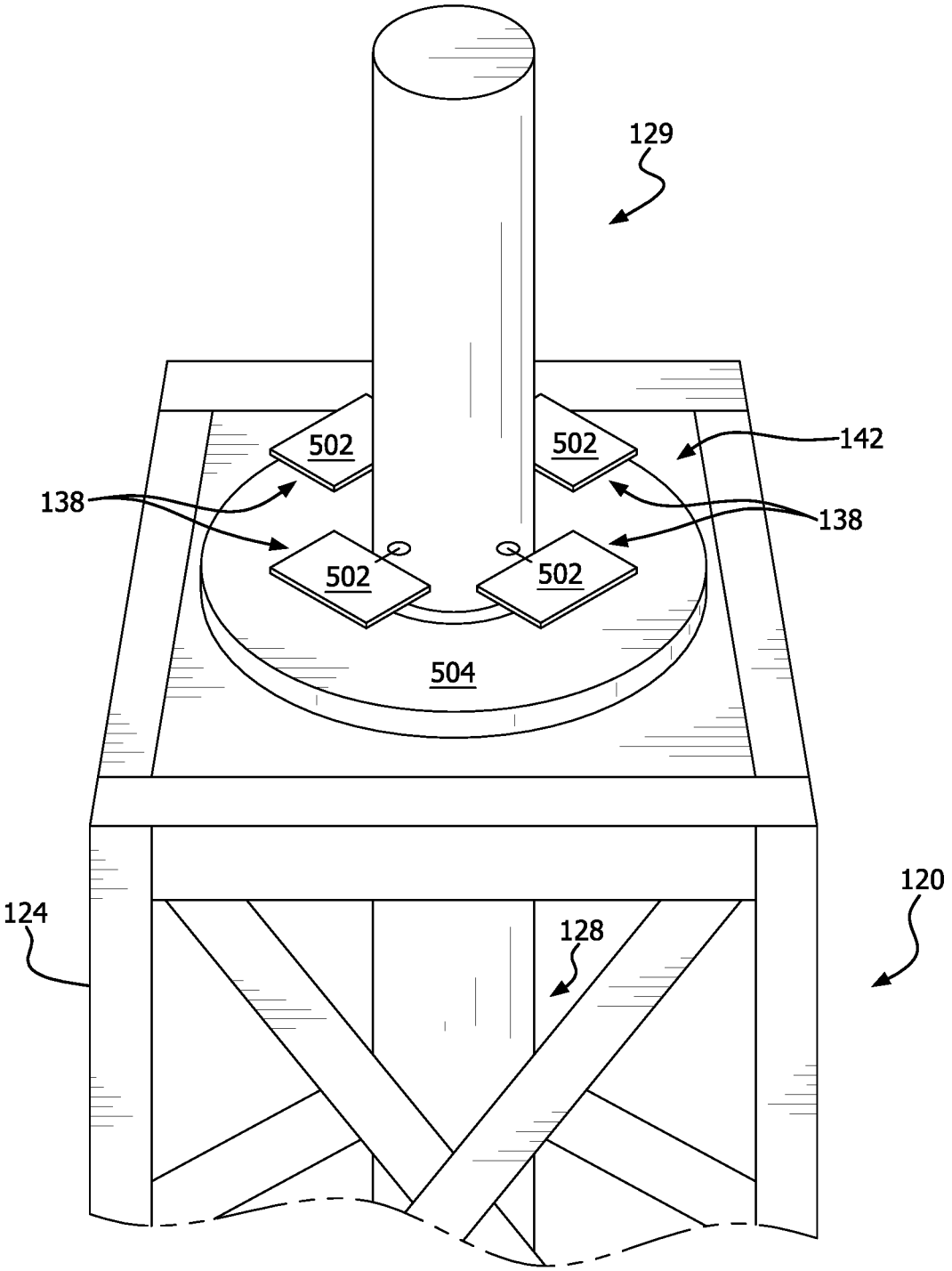
FIG. 5 is a conceptual drawing that is useful for understanding one example of an antenna feed configuration for use with a folded optics reflector.

In the antenna system 100, a circular opening or aperture 140 is defined in the center of the mesh reflector 122. Further, an RF feed 138 for the antenna system can be disposed behind the primary reflector surface. In some scenarios, the RF feed 138 can be disposed around a periphery of the mast, in an area which is on or adjacent to the housing 120. For example, in the configuration shown in FIG. 2, the feed can be disposed adjacent to a deployment face 142 of the housing 120 from which the mast assembly 128 extends in its deployed configuration. An example of such a feed configuration is illustrated in FIG. 5, which shows a plurality of distributed feed elements 502 disposed circumferentially around a periphery of a mast assembly 128. According to one aspect, the distributed feed elements 502 can be comprised of a plurality of monopole antennas which are suspended over a ground plate 504. In some scenarios, the distributed feed elements can be configured to operate as a phased array. However, the solution is not limited in this respect and other feed arrangements can also be used to provide an advantageous RF beam pattern as described below.

Figure 6:
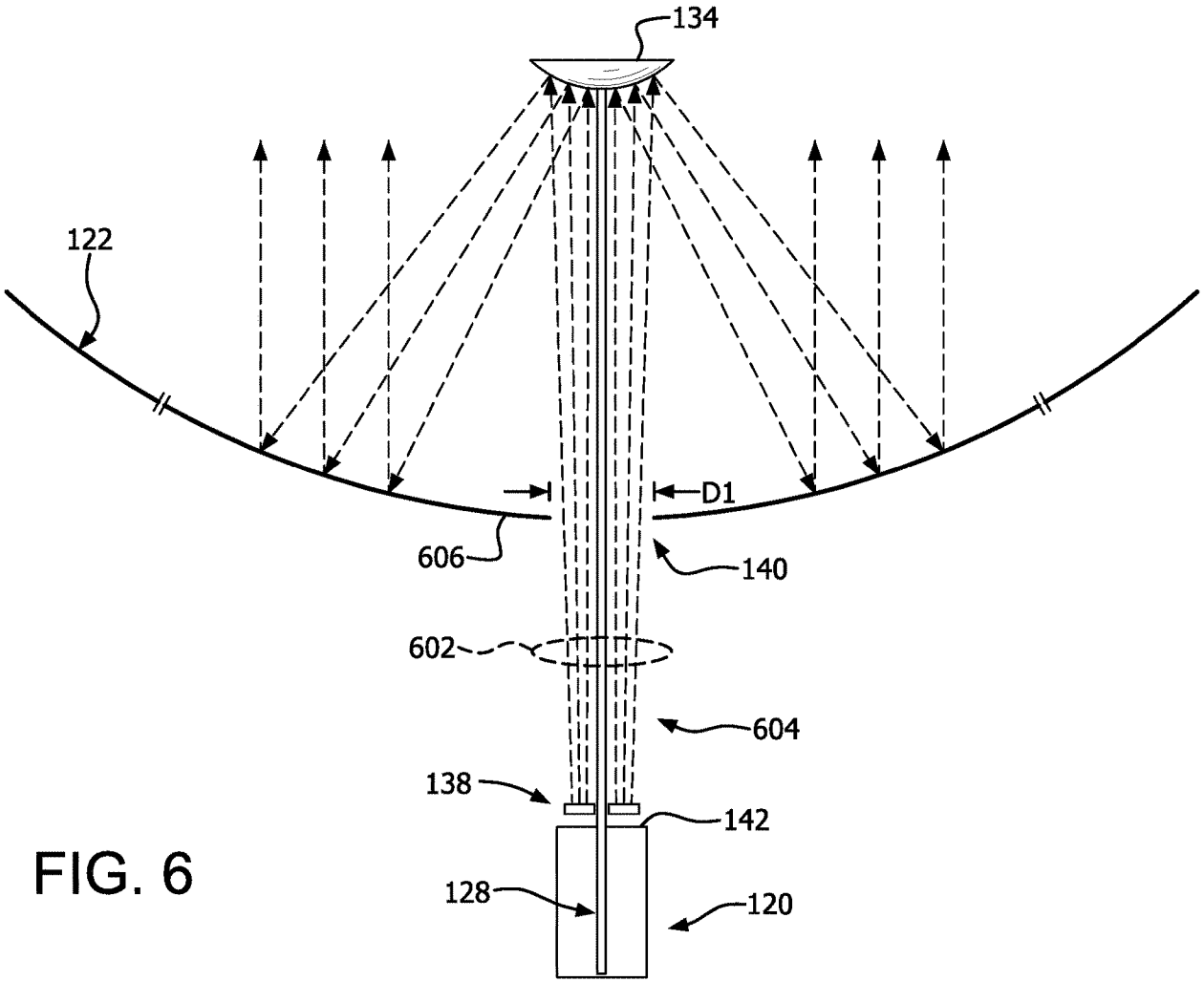
FIG. 6 is a schematic drawing which is useful for understanding the operation of the antenna system shown in FIGS. 1-5.

As shown in FIG. 6, the distributed feed elements 502 are collectively configured so that they are capable of generating an RF feed beam pattern 602 that is suitable for communicating RF energy 604 through the aperture 140 that is formed in the mesh reflector 122. The exact configuration of the distributed feed elements is not critical provided that the RF beam results in negligible amounts of RF energy being reflected back toward the RF feed 138 from the rear surface 606 of the mesh reflector 122. The RF energy 604 is reflected by the subreflector 134 and directed toward the surface of the primary mesh reflector 122 which forms the final beam. It will be appreciated that FIG. 6 is illustrative of a transmit scenario, but the solution is not limited in this regard. The antenna system 100 will operate in a similar manner in a reciprocal manner the receive direction such that both receive and transmit operations are supported.

The design methods equations for folded optic reflectors antennas (such as Cassegrain and Gregorian types) are well known and therefore will not be described here in detail. These well-known design techniques can be applied using conventional methods to establish the basic geometry of the folded optics reflector antenna. After the basic antenna geometry has been defined, the diameter D1 of aperture 140 can be selected.

One important consideration when selecting the aperture diameter D is to ensure that only negligible amounts of RF energy 604 will be reflected back toward the RF feed 138 from the rear surface 606 of the mesh reflector 122. A further consideration involves ensuring that the sub-reflector 134 is adequately illuminated by the RF energy 604. In this regard, the diameter of the aperture 140 will depend on a variety of factors such as the directivity or beam-width of the RF feed beam 602 produced by the RF feed 138, the diameter of the subreflector, the diameter of the main reflector, the distance between the feed and focus of the subreflector, and the specified antenna efficiency. If the aperture is too large or too small, antenna efficiency can be negatively affected. In some scenarios, the size of the aperture can be determined based on an iterative optimization process. For example, the diameter of the aperture 140 can be adjusted to maximize antenna gain and efficiency, while ensuring a final antenna system pattern with low side lobes.

From the foregoing it will be appreciated that the beam-width and pattern of the RF feed beam 602 can have significant impact on the overall design of an antenna system 100. However, optimizing the RF feed beam 602 can be challenging in the presence of the mast assembly 128. In this regard it may be noted that a mast assembly 128 is conventionally comprised of a metal or graphite material. These highly conductive materials can potentially cause distortion of the RF feed beam 602. Accordingly, for improved performance it can be advantageous in some scenarios to avoid the use of graphite or metal materials in the mast assembly, and instead exclusively form the mast from one or more different types of low-loss dielectric materials which are transparent to RF energy 604. Such an arrangement can significantly reduce the negative effect that the presence of a metal or graphite mast assembly can otherwise have upon the RF feed beam 602. Suitable materials that can be used for this purpose in include but are not limited to dielectric materials such as thermoplastic polyetherimide (PEI) resin composite tubing, polyimide inflatable tube, UV hardened polyimide tube, or composites of glass fiber-reinforced polymer (fiberglass weave or winding).

A folded optics type of antenna is advantageous as it reduces the overall height of the antenna along a central axis of the main reflector. An advantage of the antenna system shown in FIGS. 1-6 is that the RF feed 138 can be located relatively close to the spacecraft 101, where an electrical power bus and/or signals are most easily accessible. This can be an important design factor in scenarios involving high frequencies (e.g. Ka Band systems) and/or high power levels where the length of an RF feed path is advantageously minimized. In contrast, a prime focus feed antenna as taught in U.S. Pat. No. 9,608,333, which places the RF feed at a focal point of the primary reflector will necessarily require that RF power be communicated a substantial distance by means of transmission lines from the spacecraft electronics to the location of the RF feed at the top of the mast.

Figure 7A:
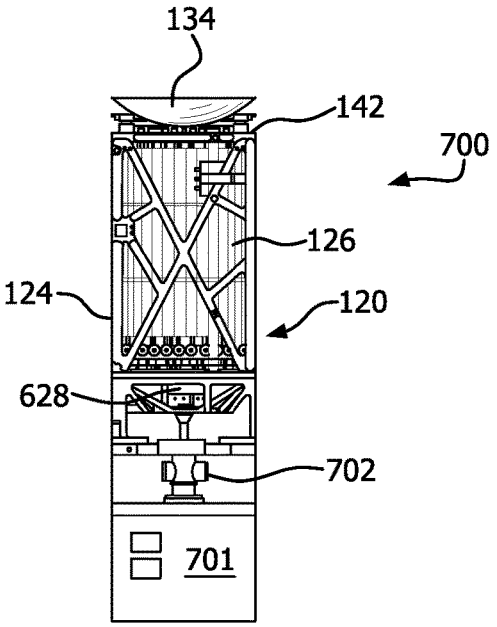
FIG. 7A is a side elevation view of folded optics reflector with an alternative antenna feed arrangement, shown in a stowed configuration.
Figure 7B:
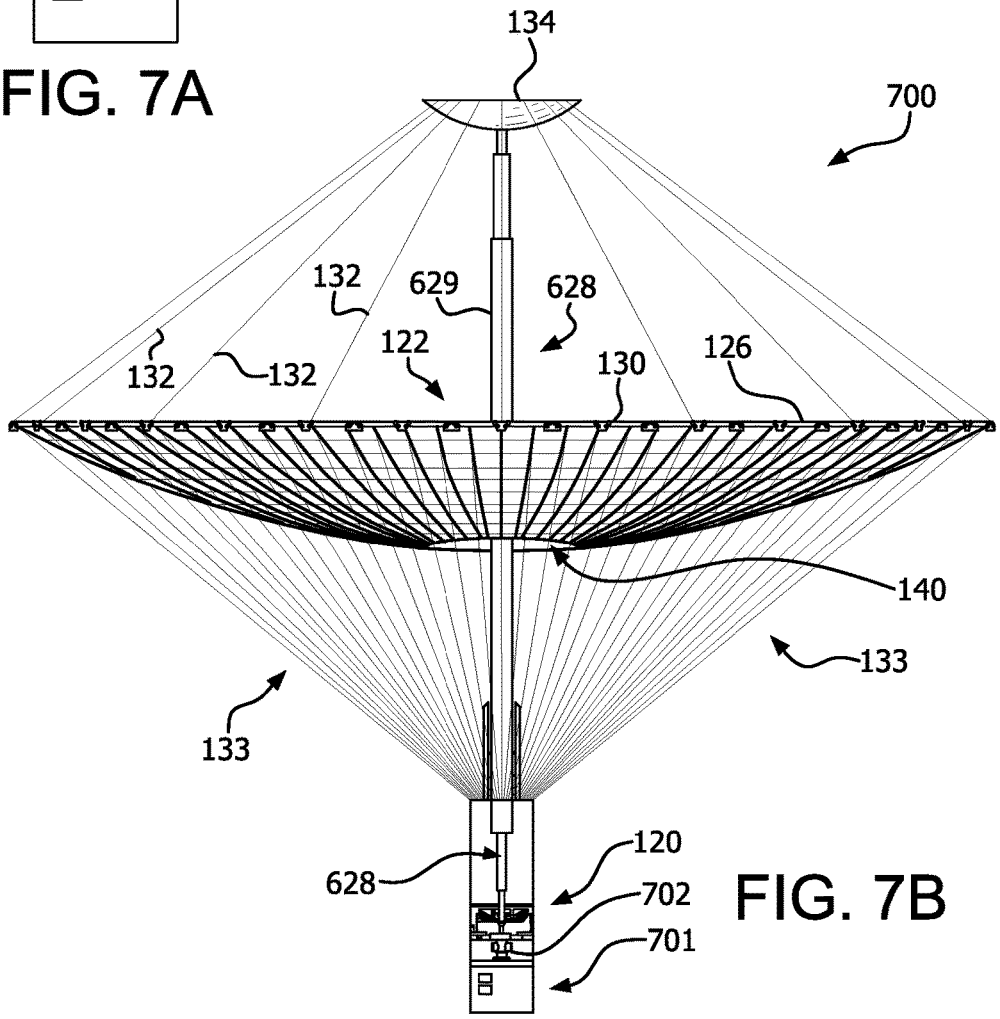
FIG. 7B is a side elevation view of the folded optics reflector of FIG. 7A in a deployed configuration.

Referring now to FIGS. 7A and 7B (collectively FIG. 7) there is shown an antenna system 700 which is similar to the antenna system 100, but having an alternative feed configuration. The antenna system 700 can in some scenarios comprise a portion of a spacecraft 701 which includes various types of equipment, including radio communication equipment. Corresponding structure in FIG. 7 is identified with the same reference numbers as are used in FIGS. 1-2. In this example, the antenna system 700 includes a coaxial feed assembly 702 disposed in the housing 120, aligned coaxial with mast assembly 628 and boom 629. The theory and operation of coaxial feed systems are known in the art and therefore will not be described here in detail. However, a brief description of the coaxial feed assembly is provided below to facilitate an understanding of the solution presented herein.

Figure 8A:
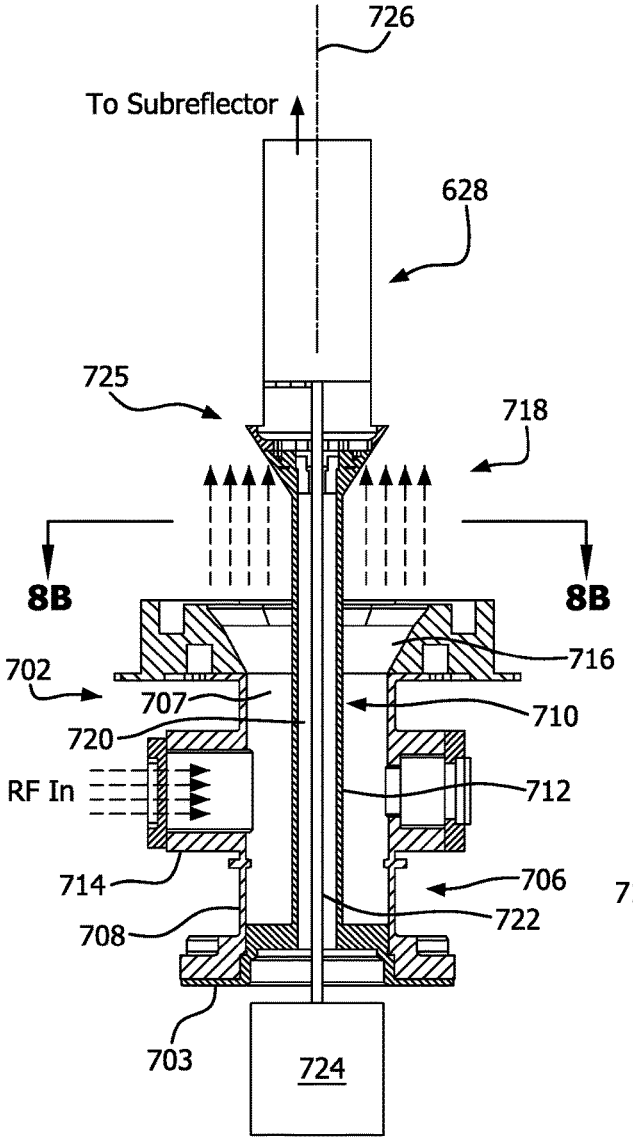
FIGS. 8A and 8B are a set of drawings that are useful for understanding a coaxial feed arrangement which can be used with the folded optics reflector of FIGS. 7A-7B.
Figure 8B:
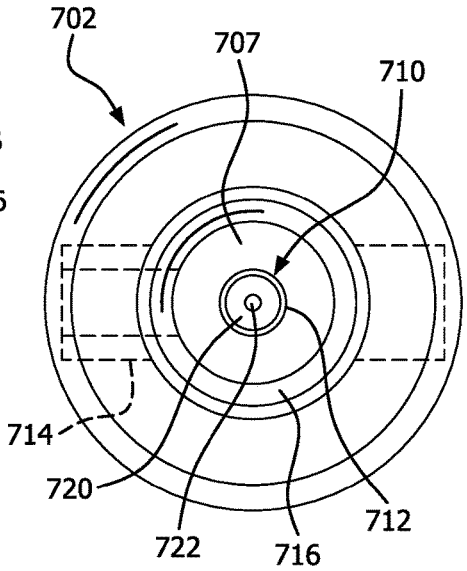

The coaxial feed assembly 702 is shown in further detail in FIGS. 8A and 8B (collectively FIG. 8). The coaxial feed is axially aligned along a central axis 726 and includes a mounting interface 703 to facilitate mounting in the housing 120. The coaxial feed is also axially aligned with the elongated length of the boom assembly 629. The mounting interface supports a waveguide section 706 which includes a conductive cylindrical outer wall 708. The cylindrical outer wall 708 is aligned on central axis 726 and is coaxial with a cylindrical inner waveguide structure 710. Inner waveguide structure 710 extends axially along the length of the waveguide section 706 and forms a conductive inner wall 712 of the waveguide structure 710. This inner waveguide structure 710 also extends coaxially through a horn 716 to a mast interface 725. The mast interface 725 provides a structural support for the mast assembly 628 and its associated boom.

The inner wall 712 and the outer wall 708 together define an elongated toroidal-shaped waveguide cavity 707. RF energy communicated to the waveguide cavity from a port 714 is communicated through the toroidal-shaped waveguide cavity 707 to the horn 716. The port 714 can advantageously comprise an orthomode transducer (OMT). The OMT combines two linearly orthogonal waveforms and in some cases can be used in an orthomode junction to create a circular polarized waveform. As shown in FIGS. 8A and 8B, the horn 716 forms an RF feed beam 718 which is coaxial with the boom 629 and directed toward the subreflector 134. A transmit scenario is illustrated in FIG. 8A but it should be understood that the operation of the feed is reciprocal in the receive direction. Accordingly, both receive and transmit operations are supported for an antenna system 700. The resulting feed configuration may be understood with reference to FIG. 9, which shows that an RF feed beam 718 produced by coaxial feed assembly 702 is communicated in axial alignment with the boom 629 and directed toward a subreflector 134 through an aperture 140 having a diameter equal to D2.

In the configuration shown in FIGS. 7-8 a hollow cylindrical cavity 720 is provided internal of the cylindrical inner waveguide structure 710. This hollow cylindrical cavity extends along the axial length of the waveguide section 706 and the horn 716 to the mast interface 725. Accordingly, a mast deployment component which facilitates extension a boom 629 from a stowed configuration shown in FIG. 7A, to a deployed configuration shown in FIG. 7B, can be disposed within the hollow cylindrical cavity 720. So one advantage of the feed configuration shown is that it allows access to deploy the boom at a location aligned on the center axis of the feed. In some scenarios, the mast deployment component 722 can extend from a mast deployment actuator 724 (located adjacent to the space craft mounting interface) to the mast interface 725. The mast deployment actuator 724 can comprise a drive train assembly, a motorized spool from which a rolled boom (e.g. a slit tube boom) is deployed, a rotating screw, or any other assembly or configuration suited for urging the mast assembly 628 to its deployed configuration.

Figure 9:
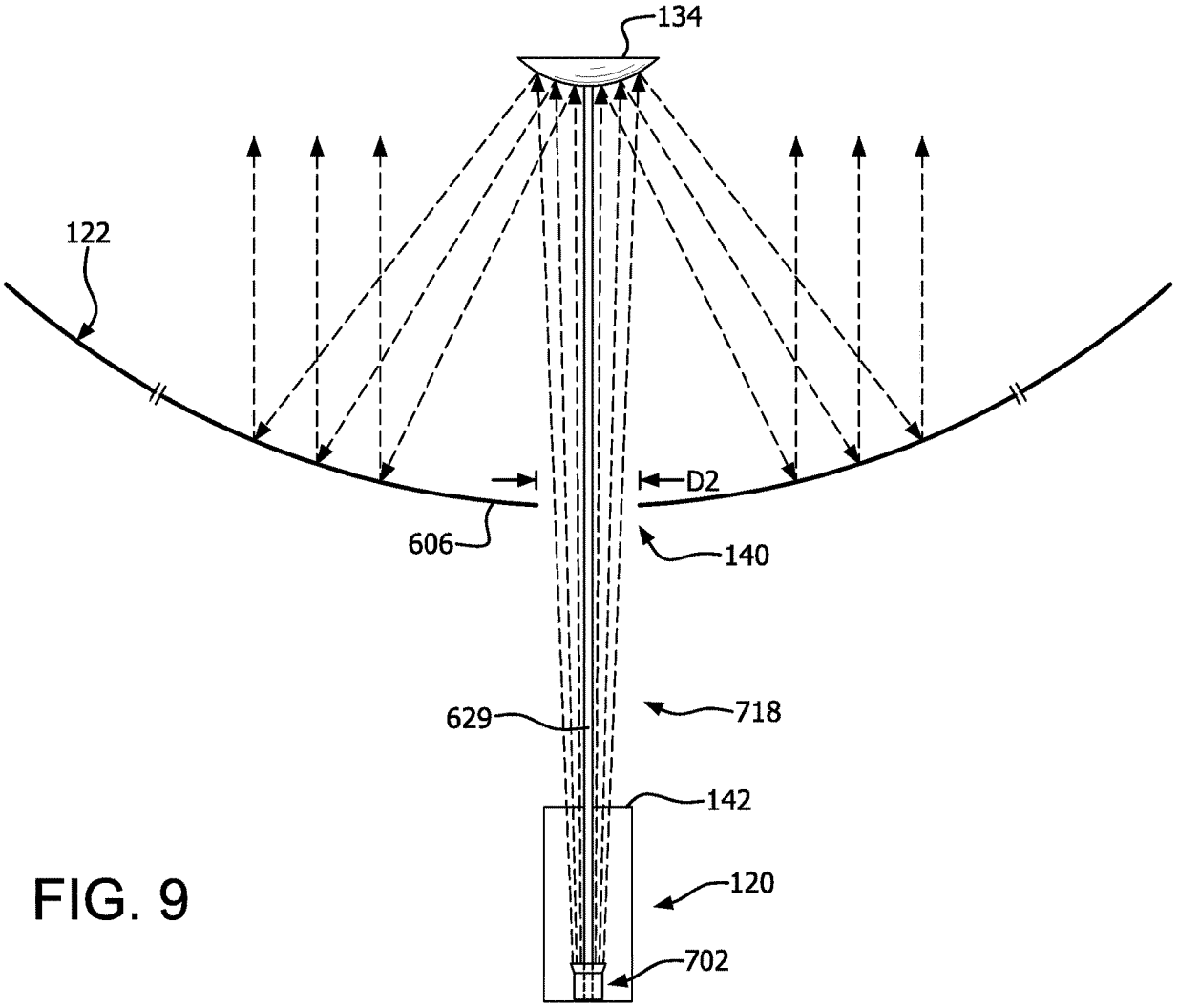
FIG. 9 is a schematic drawing that is useful for understanding the operation of the folded optics reflector system shown in FIGS. 7A and 7B.

The arrangement shown in FIGS. 7-9 has several advantages. As shown in FIG. 7, the feed is placed under the deployable mesh reflector 122, opposed from a deployment face 142 from which the mesh reflector surface 122 is deployed. In contrast to the arrangement shown in FIGS. 1, 2 and 5, the feed configuration shown in FIGS. 7-9 minimizes any potential for the RF feed assembly to interfere with the deployment of the mesh reflector 122. A further advantage of the configuration shown in FIG. 7-9 is that the feed can be located directly adjacent to the spacecraft 701 where power and RF signals are most easily coupled to the feed assembly 702 with minimal losses. A further advantage of the approach shown in FIGS. 7-9 is that the feed is moved closer to the spacecraft, which further minimizes distance, RF losses and antenna moment of inertia.

Figure 10A:
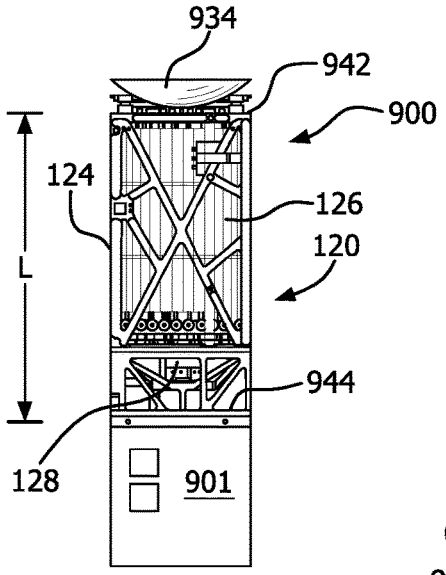
FIG. 10A is a side elevation view of folded optics reflector with a second alternative antenna feed arrangement, shown in a stowed configuration.
Figure 10B:
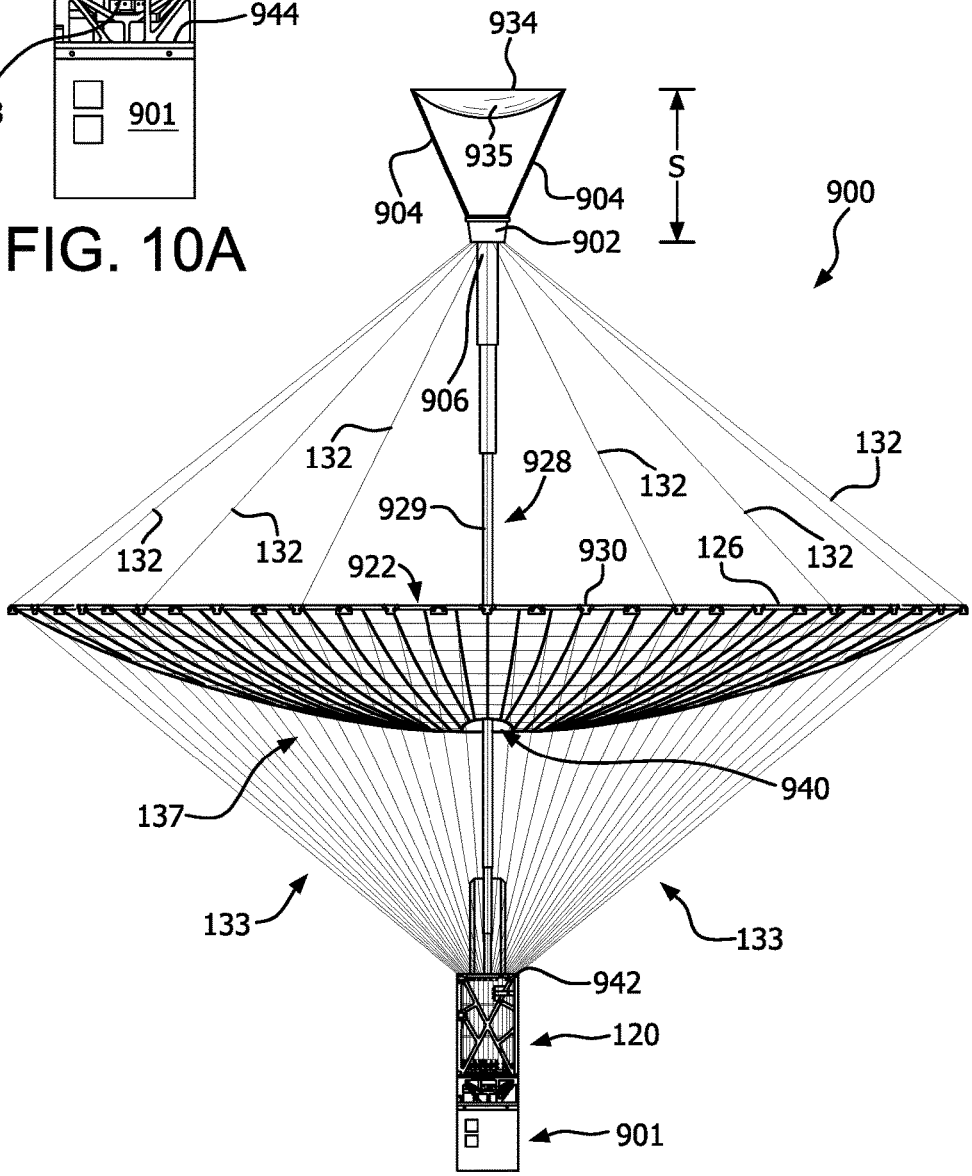
FIG. 10B is a side elevation view of the folded optics reflector of FIG. 10A in a deployed configuration.
Figure 11:
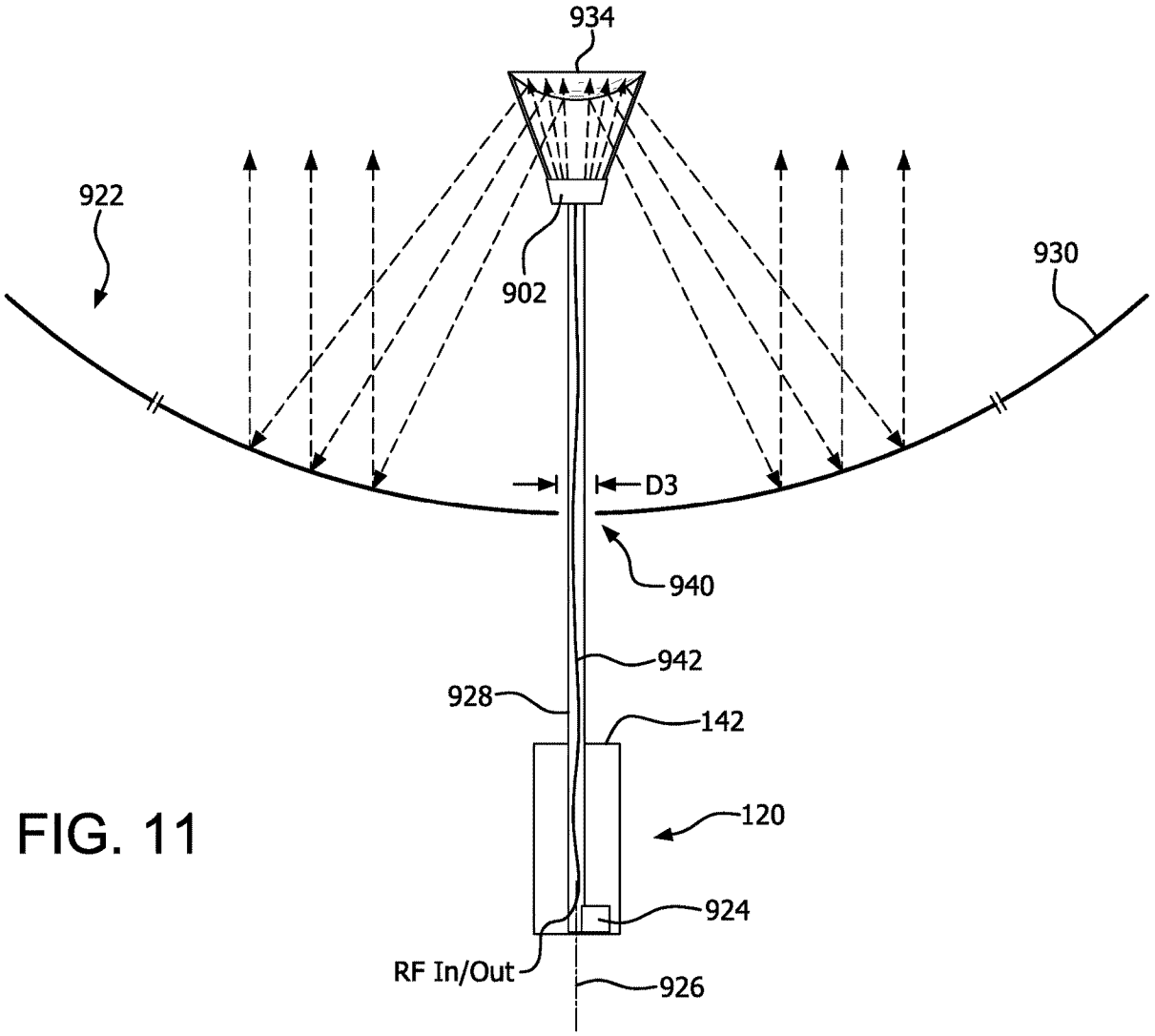
FIG. 11 is a schematic drawing that is useful for understanding the operation of the folded optics reflector system shown in FIGS. 10A and 10B.

An alternative scenario for a folded optics reflector antenna system 900 is illustrated in FIGS. 10A-10B (collectively FIG. 10) and FIG. 11. As may be observed in the figures, the antenna system 900 is similar to the antenna system 100, 700 but has an alternative feed configuration. The antenna system 900 can in some scenarios comprise a portion of a spacecraft 901 which includes various types of equipment, including radio communication equipment. Corresponding structure in FIGS. 10 and 11 is identified with the same reference numbers as are used in FIGS. 1-2, 6, 7, and 9.

The antenna system 900 includes a deployable mesh reflector 922 comprised of a collapsible, mesh reflector surface 930 which is supported by a circumferential hoop assembly 126. The reflector surface has a shape when deployed that is selected so as to concentrate RF energy in a desired pattern. As such, the reflector surface can be parabolic or can be specially shaped in accordance with the needs of a particular design. For example in some scenarios the reflector surface can be specially shaped in accordance with a predetermined polynomial function. Further, the reflector surface 930 can be surface of revolution, but it should be understood that this is not a requirement. There are some scenarios when the reflector surface is an axisymmetric shape.

The hoop assembly 126 is supported by means of a plurality of cords 132 and a boom 929 associated with mast assembly 928. A further network of cords 133 can extend between the housing 120 and the mesh reflector 922 to help define the shape of the mesh reflector surface 930. It should be understood that the hoop assembly 126 and the mast assembly 928 are configured to collapse into a stowed configuration which fits within the interior space of the housing 120, in a manner similar to the antenna system 100, shown in FIG. 1.

In the antenna system 900, an RF feed 902 is provided at a free end 906 of extendable boom 929, opposed from the housing 120 when the antenna is in the deployed configuration shown in FIG. 10B. Spaced apart from the free end of the mast a further distance S from the housing 120 is a subreflector 934 which is supported on one or more elongated struts 904 or RF transparent radome. The one or more elongated struts 904 can be attached at a first end portion to the free end of the boom 929 (or to a housing associated with the RF feed 902) and at a second end portion to the subreflector 934. The subreflector 934 is comprised of a material which is highly reflective of RF energy such as metal. The subreflector 934 which is shown in FIGS. 10 and 11 has a convex reflector face 935 to facilitate a Cassegrain type of reflector antenna system, in which the mesh reflector 922 serves as the primary reflector. However, it should be appreciated that implementations are not limited in this regard. In other scenarios the subreflector 934 could also define a concave reflector face to facilitate a Gregorian type of reflector antenna system.

Figure 12:
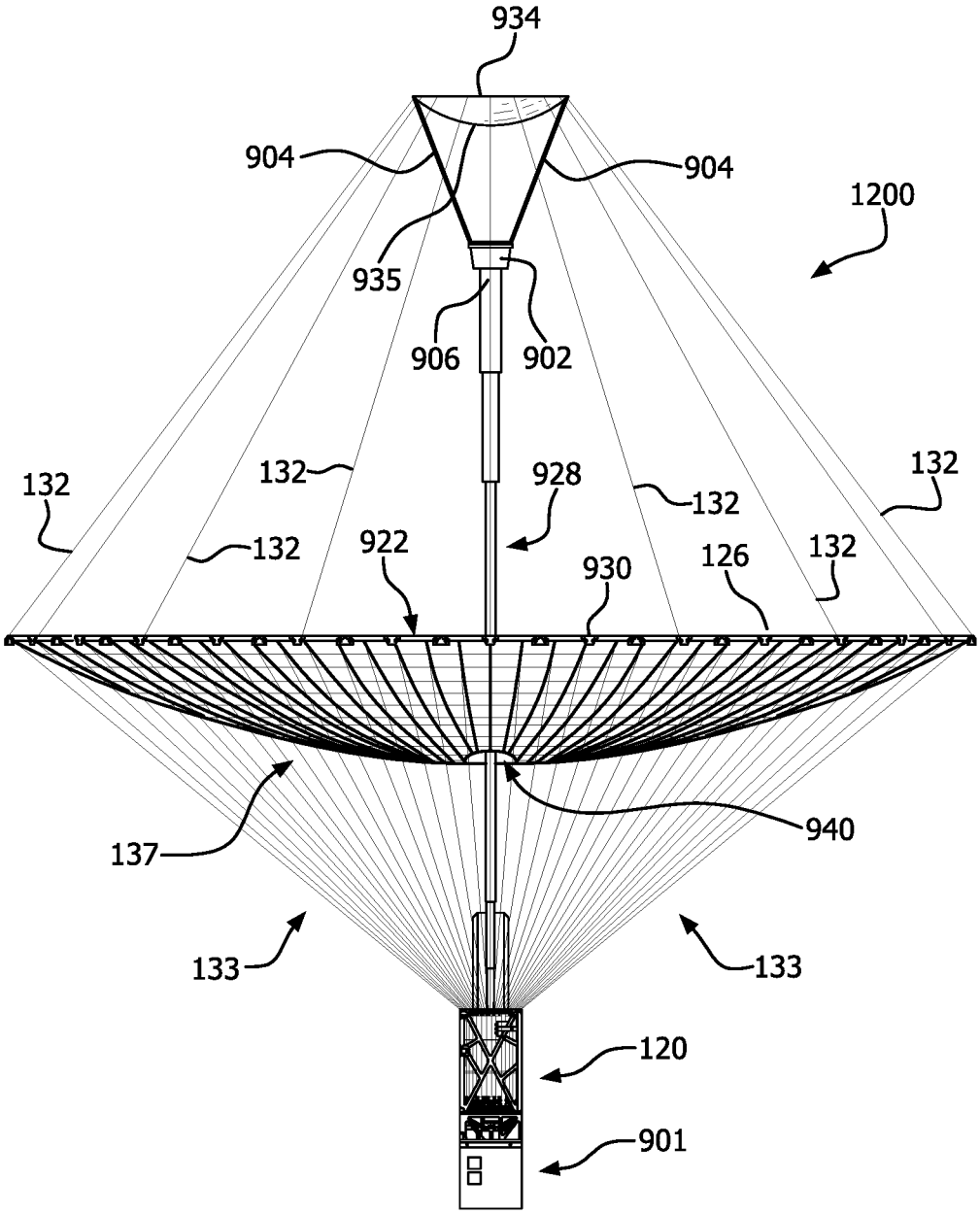
FIG. 12 is a side elevation view of an alternative embodiment of the folded optics reflector antenna shown in FIG. 10B.

In the scenario shown in FIG. 10B, the cords 132 are anchored at the free end 906 of the mast assembly. However, the solution is not limited in this respect and in other scenarios the subreflector 934 can advantageously function as part of the support system for the mesh reflector surface 930 insofar as it can be used to anchor or support ends of the cords 132. Such a scenario is illustrated in FIG. 12 which shows a similar antenna system 1200 in which the subreflector 934 is used to anchor or support ends of the cords 132. This arrangement can facilitate a packaging option in which the boom is made somewhat shorter as compared to the boom provided in the antenna system 900.

A drive train assembly 924 is positioned within the housing 120 and is configured to urge the boom 929 to extend to the deployed configuration shown in FIG. 10B. As explained above, the hoop assembly 126 is advantageously configured to be self-deploying such that the deployed hoop structure shown in FIG. 10B is achieved without any motors or actuators other than the drive train assembly which is used to extend the boom. Drive train assemblies which are used for extending booms of deployable satellite antennas are known and therefore will not be described in detail. However, it should be understood that the deployment system employed for boom 929 can be similar to that deployment system which is used for boom 629. For example, the boom can comprise a split-tube type boom which is stored on a spool 924 within housing 120, a rolled boom with a lenticular or open triangular cross section, or a pantograph configuration. As another example, the extendible boom assembly may include a plurality of links that slide relative to one another such that the boom assembly automatically extends from a collapsed configuration where the links are nested together and an expanded configuration wherein the link members extend substantially end to end.

In the scenario shown in FIGS. 10 and 11, RF energy can be communicated between the spacecraft and the feed 902 by any suitable means, such as a coaxial cable 942 or a waveguide which extends internally along the length of the boom 929. When the antenna system 900 is functioning in transmit mode, the feed 902 illuminates the convex reflector face 935 with RF energy as shown in FIG. 11. In accordance with conventional folded optic RF reflector design, the RF energy from the subreflector 934 is then reflected to the face of the primary deployable mesh reflector 922. The deployable mesh reflector 922 then redirects the RF energy in a direction aligned with the main antenna axis in accordance. A transmit scenario is illustrated in FIG. 11 but it should be understood that the operation of the feed is reciprocal in the receive direction. Accordingly, both receive and transmit operations are supported for an antenna system 900.

The mesh reflector 922 can have an aperture 940 aligned with central reflector axis 926 to facilitate passage of the boom 929 through the mesh reflector 922 in alignment with the central reflector axis. Since the RF feed 902 in this scenario is located at the top of the boom, spaced apart from the subreflector 934, the diameter D3 of the aperture 940 can be made just large enough to accommodate the diameter of the boom 929 without concern for interference with a transmitted RF feed beam. In other words, the magnitude of D3 can be less than D1 and/or D2.

Standard design techniques can be applied to establish the basic geometry of the folded optics reflector antenna. However, in some scenarios a distance S between the subreflector 934 and the feed 902 can be advantageously selected in accordance with a length L of the housing 120. For example, it can be advantageous to take advantage of the housing length L as part of the system design by increasing the distance S so that the subreflector and the feed reside substantially at the top 942 and the bottom 944 of the housing 120, respectively. Such a configuration can facilitate an antenna geometry that is very favorable for certain types of folded optic antenna configurations. This configuration can also allow the overall package in the stowed state to be more compact.

The described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

We claim:

1. A folded optics reflector system, comprising:

a hoop assembly comprising a plurality of link members extending between a plurality of hinge members, the hoop assembly configured to expand between a collapsed configuration wherein the link members extend substantially parallel to one another and an expanded configuration wherein the link members define a circumferential hoop;

a collapsible mesh reflector surface secured to the hoop assembly such that when the hoop assembly is in the collapsed configuration, the reflector surface is collapsed within the hoop assembly and when the hoop assembly is in the expanded configuration, the reflector surface is expanded to a shape that is intended to concentrate RF energy in a desired pattern;

a mast assembly including an extendible boom, wherein the hoop assembly is secured by a plurality of cords relative to a top portion of the boom and to a bottom portion of the boom such that upon extension of the boom to a deployed condition, the hoop assembly is supported by the boom; and a subreflector is disposed at the top portion of the boom.

2. The folded optics reflector system according to claim 1, wherein an antenna feed is disposed at the top portion of the boom and the subreflector is supported on one or more struts or RF transparent radome which extends from the top portion of the boom or the antenna feed so as to space the subreflector a predetermined distance from the antenna feed.

3. The folded optics reflector system according to claim 1, wherein an antenna feed is disposed at or adjacent to the bottom portion of the boom.

4. The folded optics reflector system according to claim 3, further comprising a feed aperture in the reflector surface coaxially aligned with an axis of the boom, wherein the antenna feed is configured illuminate a reflector face of the subreflector with radio frequency (RF) energy that is propagated through the feed aperture.

5. The folded optics reflector system according to claim 3, wherein the antenna feed is comprised of a plurality of radiating elements which are disposed around a periphery of the boom to form an array.

6. The folded optics reflector system according to claim 3, wherein the antenna feed is a coaxial feed which is axially aligned with the mast assembly.

7. The folded optics reflector system according to claim 6, wherein the coaxial feed is comprised of a cylindrical inner waveguide structure which defines a hollow tubular cavity axially aligned with the mast assembly, and at least one deployment component extends through the tubular cavity to facilitate extension of the boom.

8. The folded optics reflector system according to claim 7, wherein at least a portion of the mast assembly is supported on the cylindrical inner waveguide structure.

9. The folded optics reflector system according to claim 1, wherein the boom is comprised of a low-loss dielectric material.

10. A folded optics reflector system, comprising:

a hoop assembly comprising a plurality of link members extending between a plurality of hinge members, the hoop assembly expands between a collapsed configuration wherein the link members extend substantially parallel to one another and an expanded configuration wherein the link members define a circumferential hoop;

a collapsible mesh reflector surface secured to the hoop assembly such that when the hoop assembly is in the collapsed configuration, the reflector surface is collapsed within the hoop assembly and when the hoop assembly is in the expanded configuration, the reflector surface is expanded to a shape that is intended to concentrate RF energy in a desired pattern;

a mast assembly including an extendible boom, wherein the hoop assembly is secured by a plurality of cords relative to a top portion of the boom and to a bottom portion of the boom such that upon extension of the boom to a deployed condition, the hoop assembly is supported by the boom;

a subreflector is disposed at the top portion of the boom; and a housing in which at least the hoop assembly, reflector surface and mast assembly are stowed prior to deployment.

11. The folded optics reflector system according to claim 10, wherein prior to deployment, the subreflector is disposed at a top of the housing, and an antenna feed is disposed in the bottom of the housing.

12. The folded optics reflector system according to claim 10, wherein after deployment an antenna feed is disposed at the top portion of the boom and the subreflector is supported on one or more struts which extend from the top portion of the boom or the antenna feed so as to space the subreflector a predetermined distance from the antenna feed.

13. The folded optics reflector system according to claim 10, wherein after deployment an antenna feed is disposed at or adjacent to the bottom portion of the boom.

14. The folded optics reflector system according to claim 13, further comprising a feed aperture in the reflector surface coaxially aligned with an axis of the boom, wherein the antenna feed is configured illuminate a reflector face of the subreflector with radio frequency (RF) energy that is propagated through the feed aperture.

15. The folded optics reflector system according to claim 13, wherein the antenna feed is comprised of a plurality of radiating elements which are disposed around a periphery of the boom to form an array.

16. The folded optics reflector system according to claim 13, wherein the antenna feed is a coaxial feed which is disposed in the bottom of the housing and axially aligned with the mast assembly.

17. The folded optics reflector system according to claim 16, wherein the coaxial feed is comprised of a cylindrical inner waveguide structure which defines a hollow tubular cavity axially aligned with the mast assembly, and at least one deployment component extends through the tubular cavity to facilitate extension of the boom.

18. The folded optics reflector system according to claim 17, wherein at least a portion of the mast assembly is supported on the cylindrical inner waveguide structure.

19. The folded optics reflector system according to claim 10, wherein the boom is comprised of a low-loss dielectric material.

* * * * *